US007722385B2

(12) United States Patent
Nakamura

(10) Patent No.: US 7,722,385 B2
(45) Date of Patent: May 25, 2010

(54) CONNECTOR AND A CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/342,436

(22) Filed: Dec. 23, 2008

(65) Prior Publication Data

US 2009/0170362 A1 Jul. 2, 2009

(30) Foreign Application Priority Data

Dec. 26, 2007 (JP) ..... 2007-334505

(51) Int. Cl.
*H01R 3/00* (2006.01)

(52) U.S. Cl. ..... 439/489; 439/352

(58) Field of Classification Search ..... 439/352–358, 439/488–489

See application file for complete search history.

(56) References Cited

U.S. PATENT DOCUMENTS

| | | | | |
|---|---|---|---|---|
| 7,252,530 | B2 | 8/2007 | Shamoto | |
| 7,476,123 | B2 * | 1/2009 | Kobayashi et al. | 439/489 |
| 7,572,142 | B2 * | 8/2009 | Katsuma | 439/489 |

* cited by examiner

*Primary Examiner*—Khiem Nguyen
(74) *Attorney, Agent, or Firm*—Gerald E. Hespos; Michael J. Porco

(57) ABSTRACT

A lock hole (22) in the form of a window is formed to penetrate a front end portion of a lock arm (15) resiliently displaceable like a seesaw. In a state where two housings (10, 50) are not connected yet, a movement of the detector (30) to a detection position is prevented by such engagement of a latching projection (39) with the lock hole (22) as not to move any further forward. A pair of reinforcing ribs (23) extending from the front end of the lock arm (15) to a position slightly behind inclination supporting legs (16) of the lock arm (15) and arranged at the opposite widthwise sides of the lock hole (22) are formed to project from the lock arm (15). The reinforcing ribs (23) increase the rigidity of the front end portion of the lock arm (15).

12 Claims, 13 Drawing Sheets

CONNECTOR AND A CONNECTOR ASSEMBLY

BACKGROUND OF THE INVENTION

1. Field of the Invention

The invention relates to a connector with a connection detecting function and to a connector assembly.

2. Description of the Related Art

U.S. Pat. No. 7,252,530 discloses a connector with a first housing that is connectable with a second housing. A plate-like lock arm is provided on the first housing and is inclinable like a seesaw. A lock hole penetrates a front end portion of the lock arm. A detector is mounted movably relative to the lock arm between a standby position and a detection position. The detector has a latch with a latching projection that engages the lock hole to hold the detector at the standby position before the housings are connected and to prevent the detector from moving toward the detection position.

A front end portion of the lock arm moves onto a lock projection of the second housing in the process of connecting the two housings and causes the lock arm to deform resiliently. At this time, the detector inclines together with the lock arm and the latching projection remains engaged with the lock hole. Therefore the detector remains prevented from moving toward the detection position. The lock arm resiliently restores when the housings reach a properly connected state. Thus, the lock projection engages the lock hole to lock the housings together. Additionally, the latching projection moves onto the lock projection and disengages from the lock hole so that the detector can move to the detection position. Accordingly, an operator can determine whether the two housings are connected properly based on whether the detector can move to the detection position.

The front portion of the lock arm has a relatively low rigidity due to the penetration of the lock hole. Thus, a strong pressing force on the detector toward the detecting position could deform the front portion of the lock arm, and such a deformation could disengage the lock hole from the latching projection. As a result, the detector may be moved inadvertently from the standby position to the detection position.

The invention was developed in view of the above situation, and an object thereof is to reliably hold a detector at a standby position.

SUMMARY OF THE INVENTION

The invention relates to a connector with a housing that is connectable with a mating housing. A lock arm is provided on the housing and is displaceable like a seesaw. A lock hole is formed in a front end portion of the lock arm. A detector is mounted to the lock arm for movement between a standby position and a detection position. A latching projection is formed on the detector and engages the lock hole to hold the detector at the standby position and to prevent the detector from moving forward to the detection position when the housing is not connected to the mating housing yet. The lock arm moves onto a lock projection of the mating housing and inclines resiliently in the process of connecting the housing to the mating housing. The detector is inclined together with the lock arm. The lock arm restores resiliently when the housing and the mating housing reach a properly connected state so that the lock hole engages the lock projection. As a result, the housing and the mating housing are locked together. Additionally, the latching projection moves onto the lock projection and is disengaged from the lock hole to permit the detector to move toward the detection position. An operator can detect whether the housing is connected properly to the mating housing based on whether the detector is permitted to move toward the detection position. One or more reinforcing ribs project from the lock arm and increase the rigidity of the lock arm. Thus, the front end portion of the lock arm will not deform sufficiently to disengage the lock hole from the latching projection even if the latching projection of the detector exerts a strong pressing force on the hole edge of the lock hole in a direction toward the detection position.

The one or more reinforcing ribs preferably extend from a position at or near the front end of the lock arm to a position behind an inclination supporting point of the lock arm and are arranged adjacent to the lock hole.

The lock arm preferably is formed with at least one connecting portion connecting at least two of the reinforcing ribs. The connecting portion increases the rigidity of the reinforcing ribs and further prevents the deformation of the front end portion of the lock arm.

The connecting portion preferably is a plate that is substantially parallel to a moving direction of the detector and that can slide in contact with the detector. Thus, the detector is guided by the connecting portion from the standby position to the detection position.

If the connecting portion was formed over an area corresponding to the resiliently deformable part of the detector, the connecting portion would need to be distanced from the detector to ensure a space for deformation of the detector. Thus, the connector would be enlarged. Accordingly, the connecting portion preferably is not in an area corresponding to a part of the detector that is resiliently deformable as the latching projection moves onto the lock. Therefore, the deformation space for the detector is ensured even if the connecting portion is near the detector. As a result, the connector can be miniaturized.

An operable portion preferably is formed near the rear end of the detector and projects more backward than the connecting portion. The operable portion can be operated to move the detector between the standby position and the detection position and to unlock the lock arm so that the lock hole is disengaged from the lock projection. Therefore, it is not necessary to form the lock arm with an operable portion and the shape of the lock arm can be simplified.

The invention also relates to a connector assembly comprising the above-described connector and a mating connector connectable therewith. The mating connector comprises a mating housing with a lock projection that interacts with the lock arm in a connection process.

These and other features and advantages of the invention will become more apparent upon reading the following detailed description and accompanying drawings.

DETAILED DESCRIPTION OF THE PREFERRED EMBODIMENTS

Figure 1:
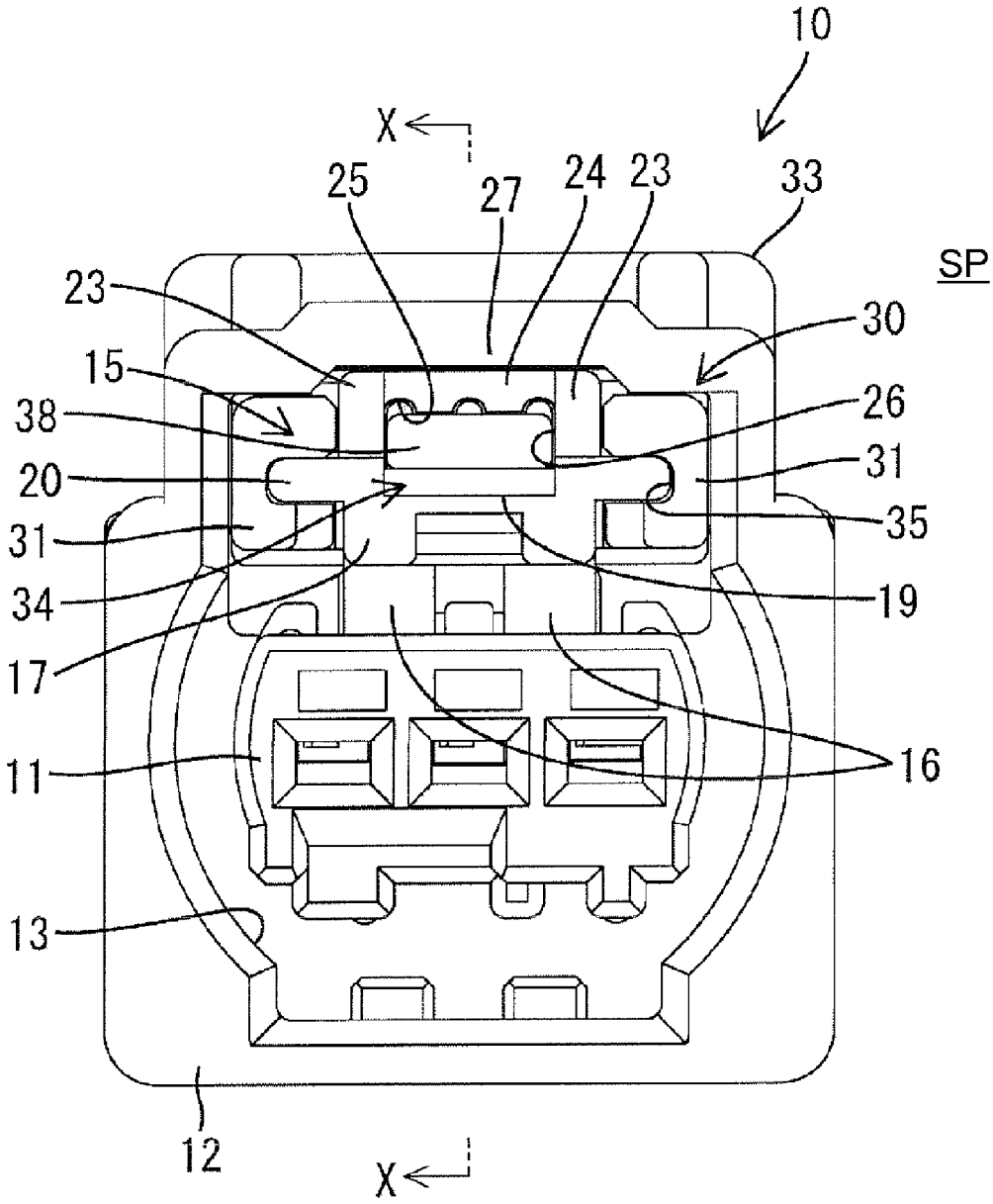
FIG. 1 is a front view of a first housing showing a state where a detector is mounted at a standby position in one embodiment.
Figure 2:
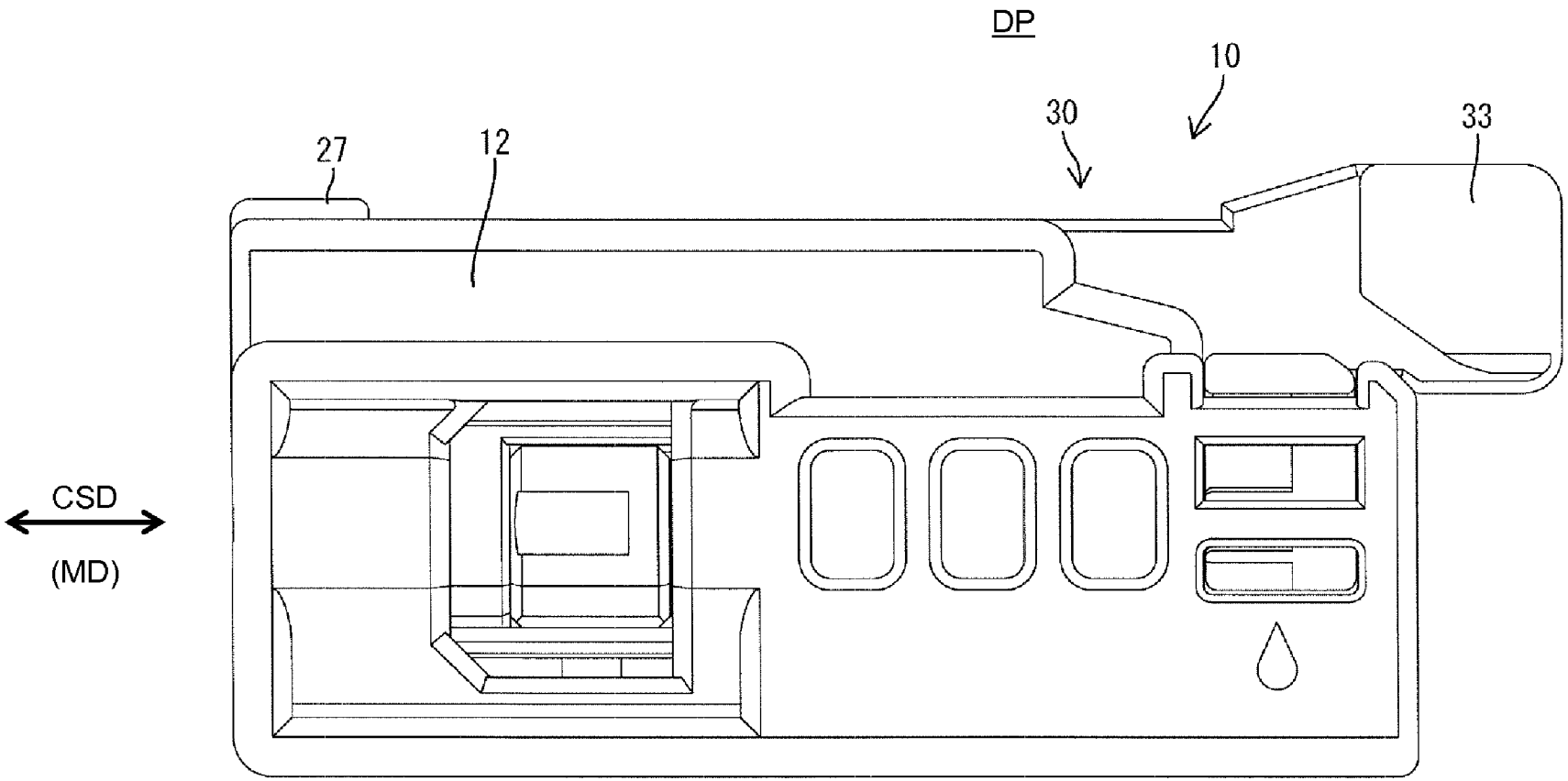
FIG. 2 is a side view of the first housing showing the state where the detector is mounted at the detection position.
Figure 3:
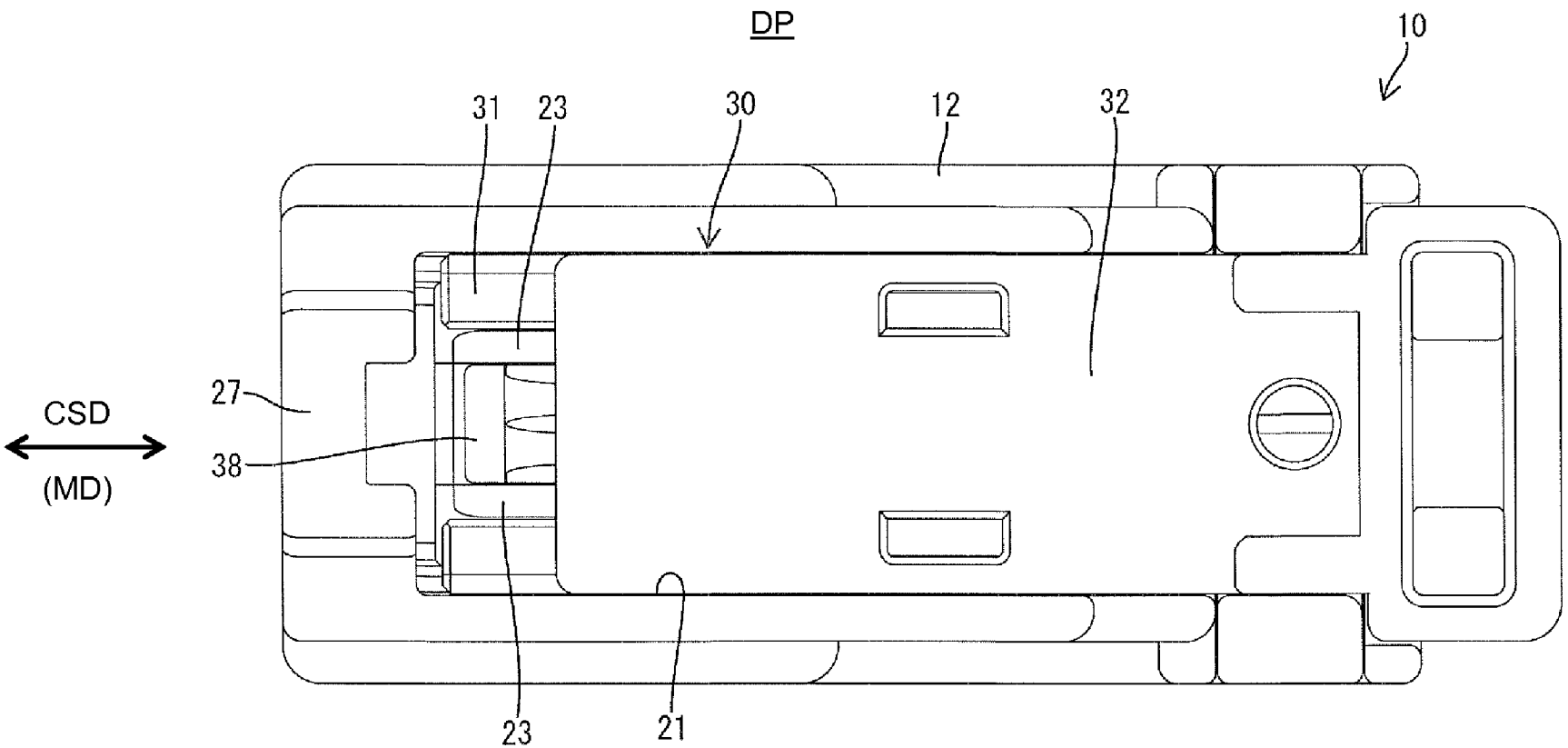
FIG. 3 is a plan view of the first housing showing the state where the detector is mounted at the detection position.

A connector in accordance with the invention is described with reference to FIGS. 1 to 14. The connector of this embodiment has first and second housings 10 and 50 that are connectable with one another. Connecting ends of the housings 10, 50 are referred to as the front ends.

The first housing 10 is made unitarily e.g. of synthetic resin to include a terminal accommodating portion 11 and a tubular fitting 12. The tubular fitting 12 surrounds the terminal accommodating portion 11 and a forwardly open connection space 13 is defined between the terminal accommodating portion 11 and the tubular fitting 12. Female terminal fittings 14 are accommodated in the terminal accommodating portion 11.

A lock arm 15 is formed unitarily on the upper surface of the terminal accommodating portion 11. The lock arm 15 is long in forward and backward directions and hence is substantially parallel to connecting and separating directions CSD of the housings 10, 50. Left and right legs 16 are formed at substantially longitudinal center positions of the lock arm 15 and join the lock arm 15 to the outer surface of the terminal accommodating portion 11. The lock arm 15 includes two laterally symmetrical beams 17 that are long and narrow in forward and backward directions. A base plate 18 connects the beams 17 from positions adjacent to or slightly before the legs 16 to the rear ends. A lock 19 connects the front ends of the beams 17, and the legs 16 project from the lower surfaces of the beams 17. Guide ribs 20 project sideways from upper parts of the outer side surfaces of the beams 17 and extend straight substantially parallel with a moving direction MD of the detector 30.

The lock arm 15 normally is kept in a locking posture in which the two beams 17 extend forward and backward in directions substantially parallel to connecting and separating directions CSD of the housings 10, 50. However, the lock arm 15 is resiliently deformable like a seesaw to an unlocking posture in which the lock 19 at the front end is displaced up and away from the outer surface of the terminal accommodating portion 11 with the legs 16 as supports. The upper wall of the tubular fitting 12 has a cutout 21 to avoid the interference with the lock arm 15 when the lock arm 15 is deformed resiliently to the unlocking posture.

A substantially rectangular lock hole 22 penetrates the front end portion of the lock arm 15 from the upper surface to the lower surface at a position bounded by the beams 17, the lock 19 and the front end edge of the base plate 18. The lock hole 22 reduces the rigidity of the front end portion of the lock arm 15. However, long narrow reinforcing ribs 23 project from the upper surfaces of the beams 17 for increasing the rigidity of at least the front end portion of the lock arm 15.

The reinforcing ribs 23 extend from the front ends to the rear ends of the beams 17. The reinforcing ribs 23 extend parallel to the connecting direction CD of the housings 10, 50 at positions on opposite sides of the lock hole 22. Upper edges of the front end portions of the reinforcing ribs 23 incline down toward the front end of the housing 10. The inclined portions extend from the front ends of the arms 17 to a substantially center position of the lock hole 22. Further, the guide ribs 20 project laterally out from the reinforcing ribs 23.

A connecting portion 24 unitarily connects the upper edges of the reinforcing ribs 23 from the rear ends of the reinforcing ribs 23 to a position slightly before the legs 16 and slightly behind the front edge of the lock hole 22. Three laterally spaced restricting grooves 25 are formed on the lower surface of the connecting portion 24 and extend forward and backward along connecting and separating directions CSD from the front end to the rear end. A guide space 26 is enclosed by the base plate 18, the reinforcing ribs 23 and the connecting portion 24. The guide space 26 has open front and rear ends.

The connector also has a detector 30 that is made unitarily e.g. of synthetic resin. The detector 30 has two long narrow side frames 31 that extend in forward and backward directions and a substantially flat plate 32 that connects the upper edges of the side frames 31. An operable portion 33 is continuous with rear ends of the side frames 31 and with the rear of the flat plate 32 and an extension 34 is cantilevered forward from the operable portion 33 between the side frames 31. Guide grooves 35 extend forward and backward along the inner surfaces of the side frames 31. The guide grooves 35 of the detector 30 slidably engage the guide ribs 20 of the lock arm 15. Thus, the detector 30 is movable relative to the lock arm 15 along a moving direction MD between a standby position SP and a detection position DP that is more forward than the standby position SP. Both the flat plate 32 and the extension 34 are substantially parallel to the moving direction MD of the detector 30.

A thick portion 36 is formed on the lower surface of the extension 34 from a position slightly behind the front end of the extension 34 to the rear end of the extension 34 at the front of the operable portion 33. A high rigidity portion 37 is defined on the extension 34 at the thick portion 36 and regulates vertical deformations substantially parallel to resilient deforming directions of the lock arm 15. A plate-like resilient piece 38 is defined at the front end of the extension 34 in an area from the front end of the high-rigidity portion 37 to the front end of the extension 34. The vertical dimension of the resilient piece 38 is less than the vertical dimension of the high-rigidity portion 37. A latch 39 projects down from the lower surface of this resilient piece 38 at a position slightly behind the front end. Further, three restricting ribs 40 extend in forward and backward directions along the upper surface of the extension 34.

Figure 5:
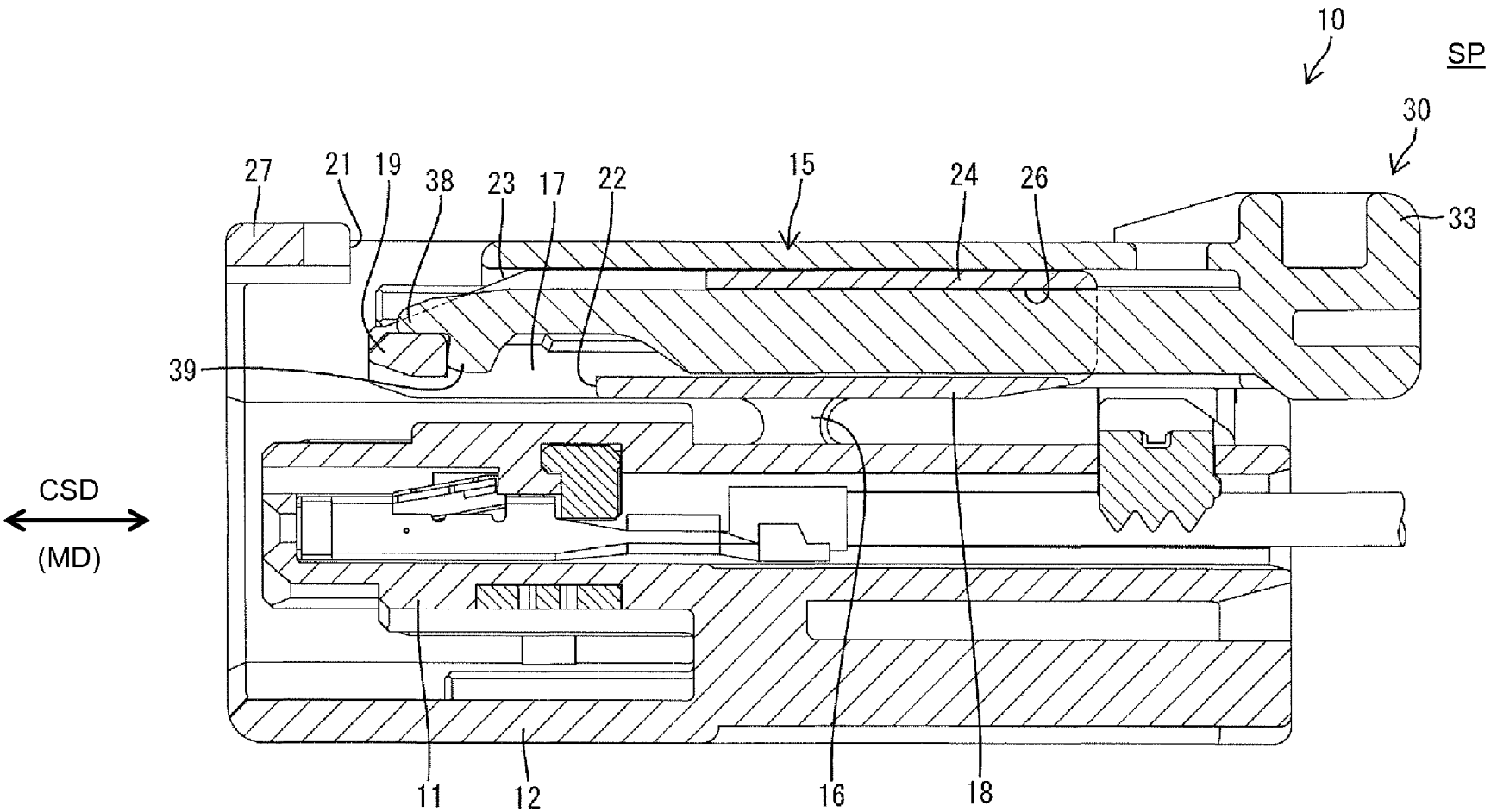
FIG. 5 is a section along X-X of FIG. 1 showing a state where the detector is located at the standby position.
Figure 6:
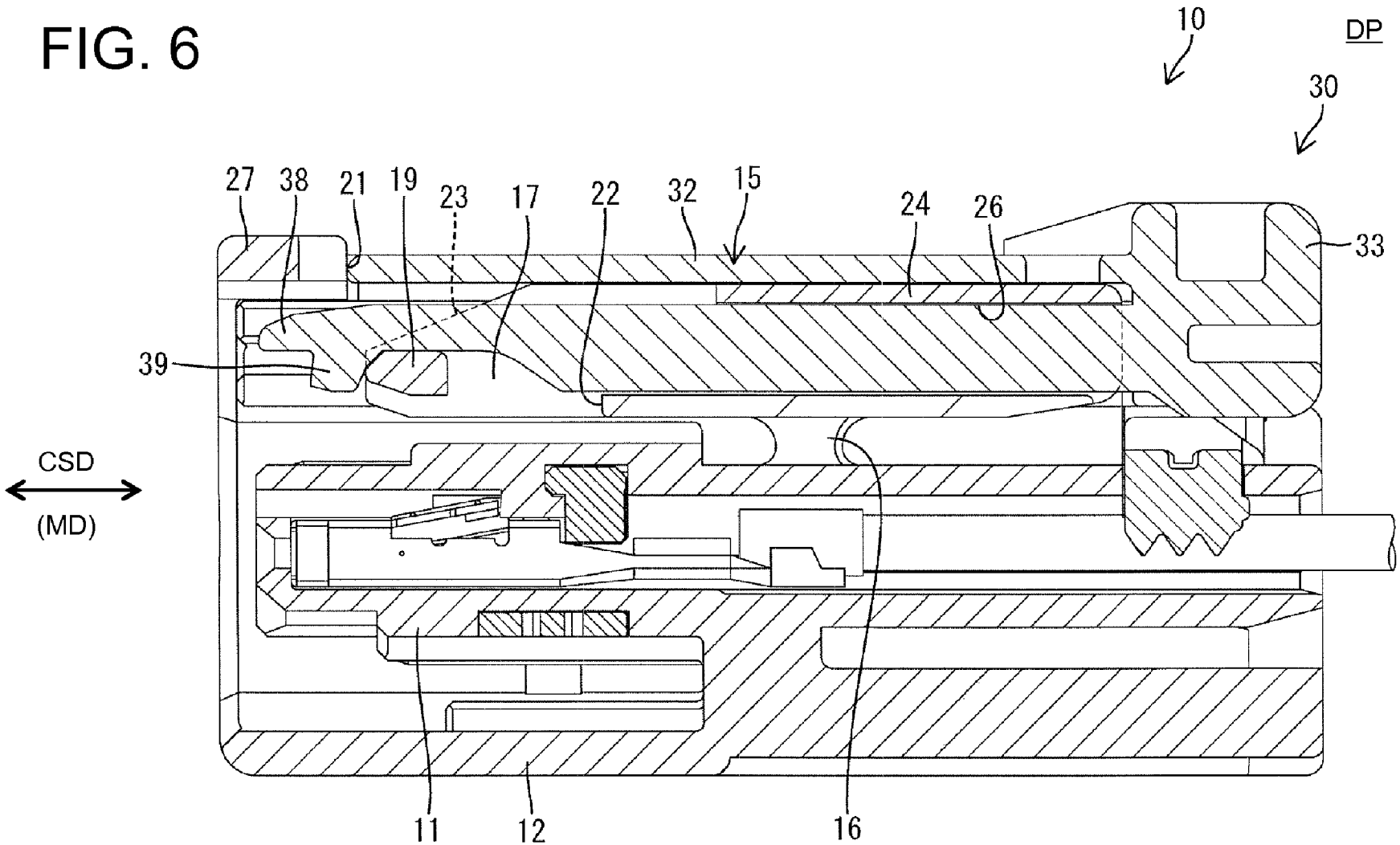
FIG. 6 is a section of the first housing showing a state reached by moving the detecting member to the detection position.
Figure 7:
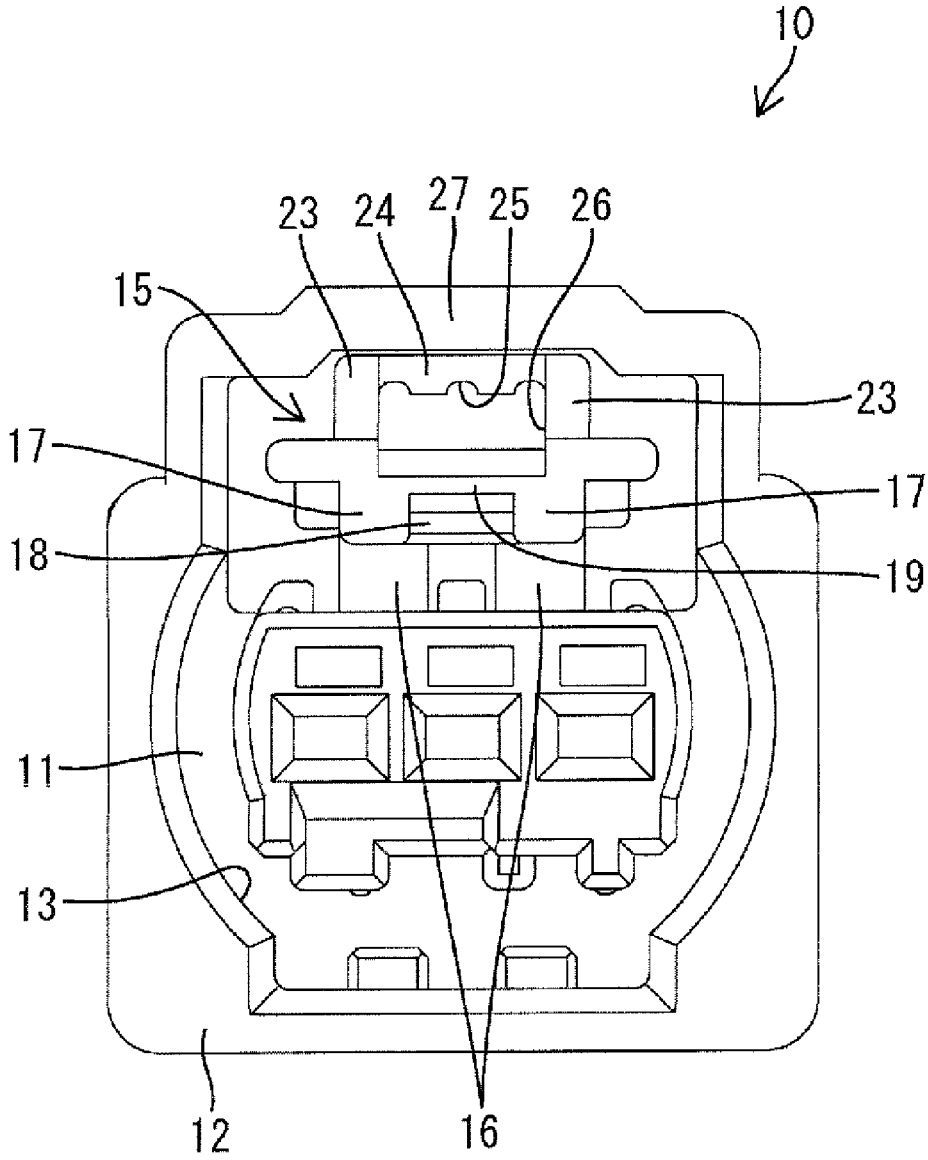
FIG. 7 is a front view of the first housing in a state where the detector is not mounted.
Figure 8:
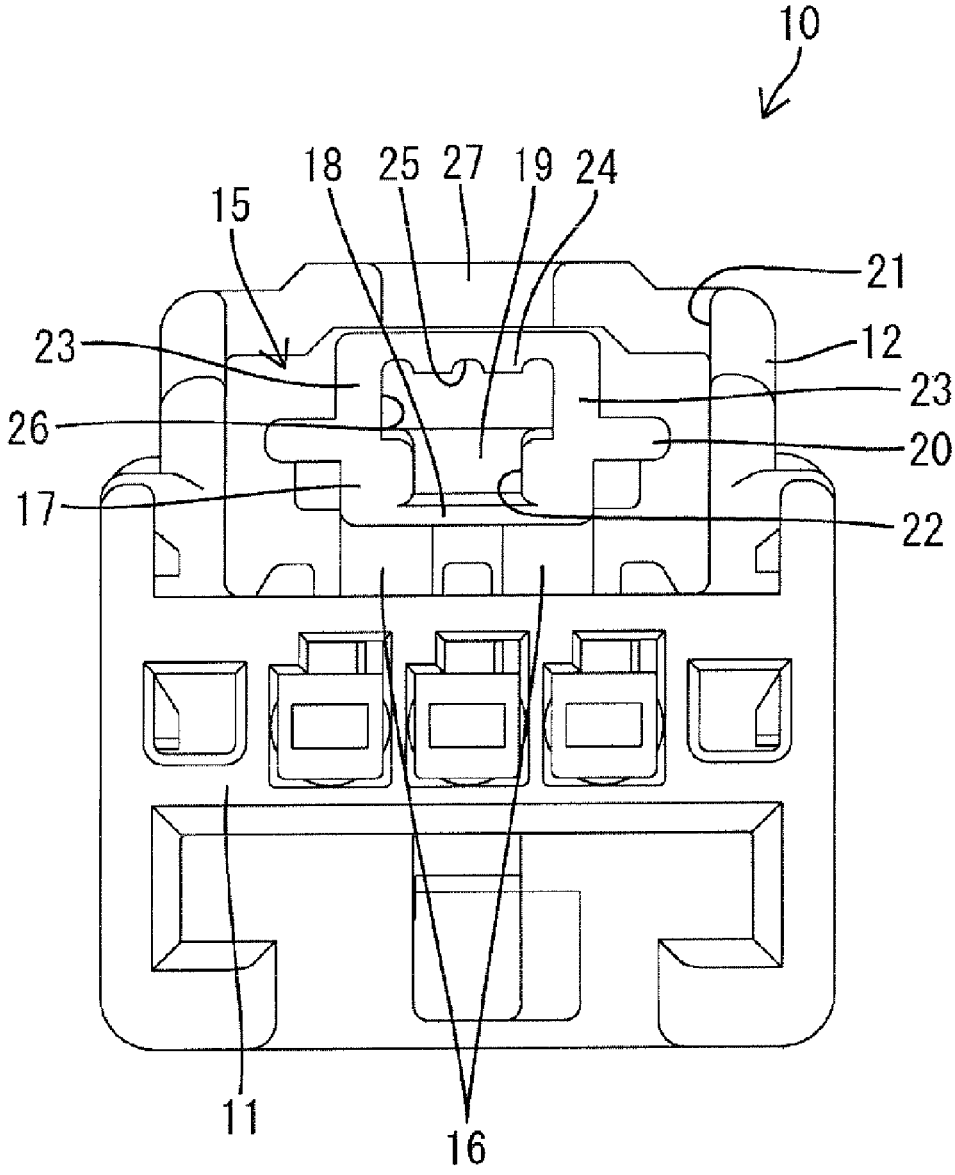
FIG. 8 is a rear view of the first housing in the state where the detector is not mounted.
Figure 9:
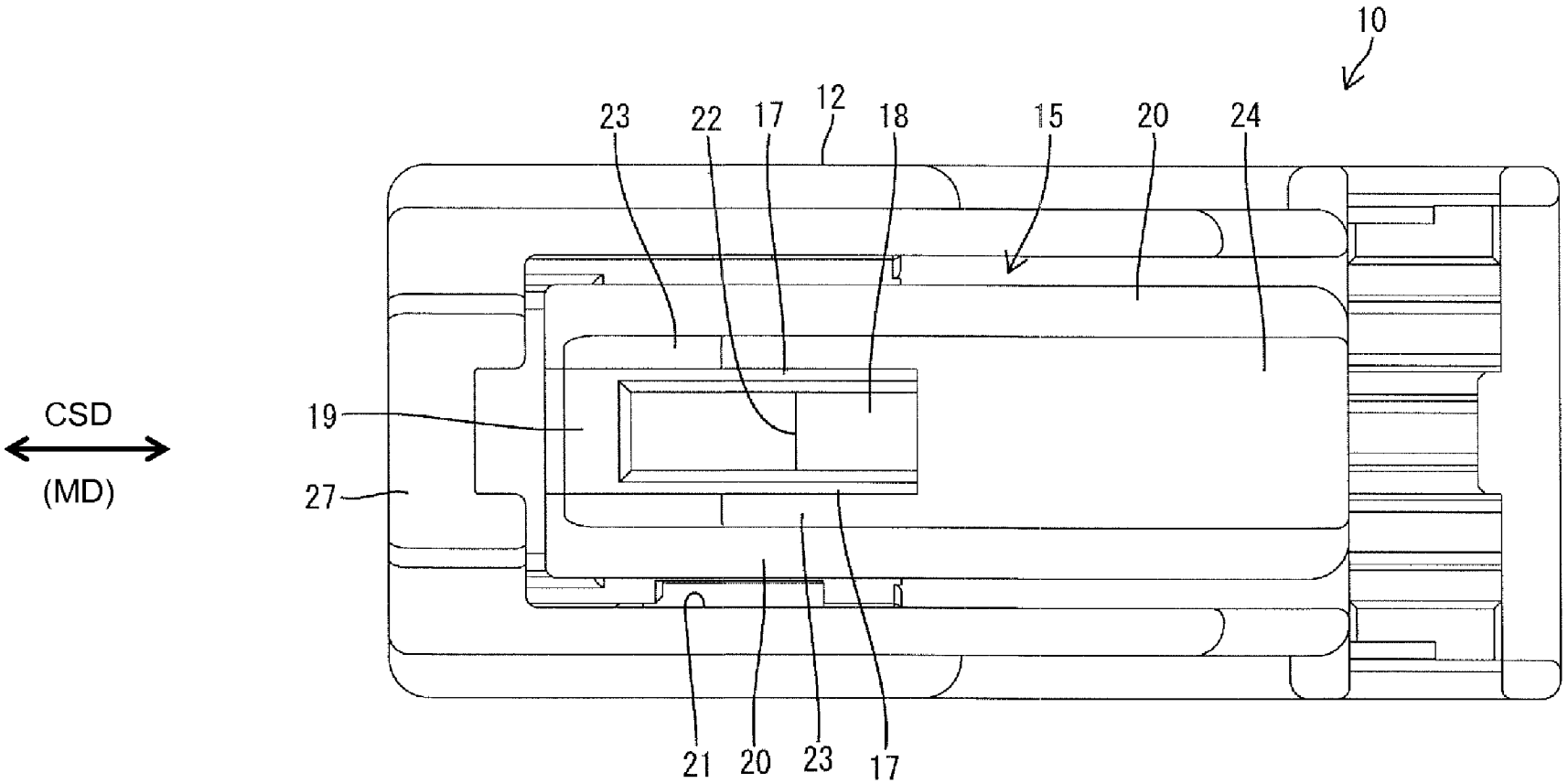
FIG. 9 is a plan view of the first housing in the state where the detector is not mounted.
Figure 10:
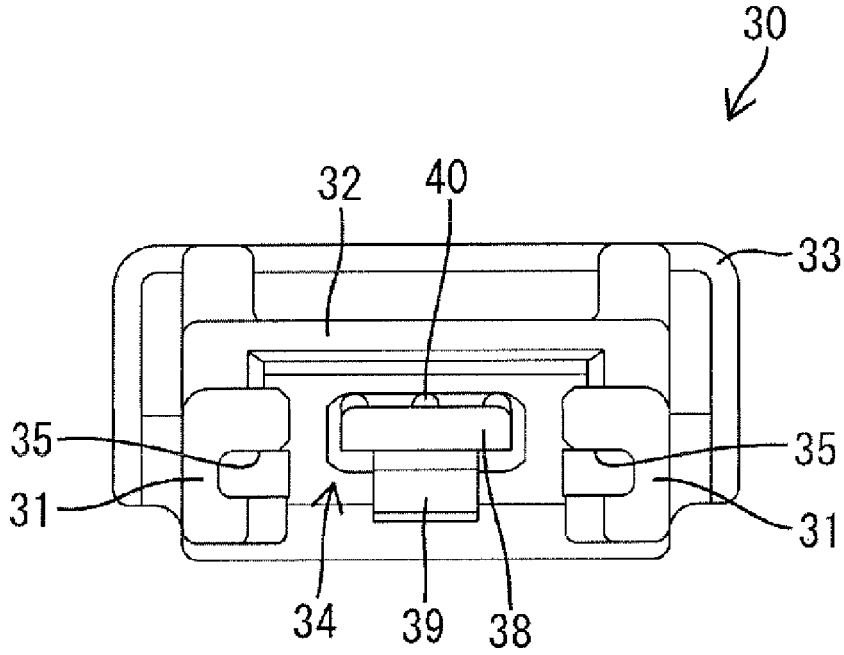
FIG. 10 is a front view of the detector.
Figure 11:
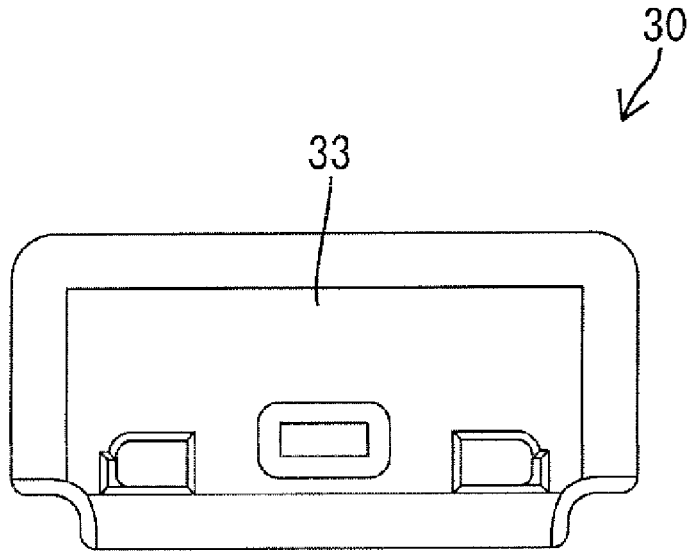
FIG. 11 is a rear view of the detector.
Figure 12:
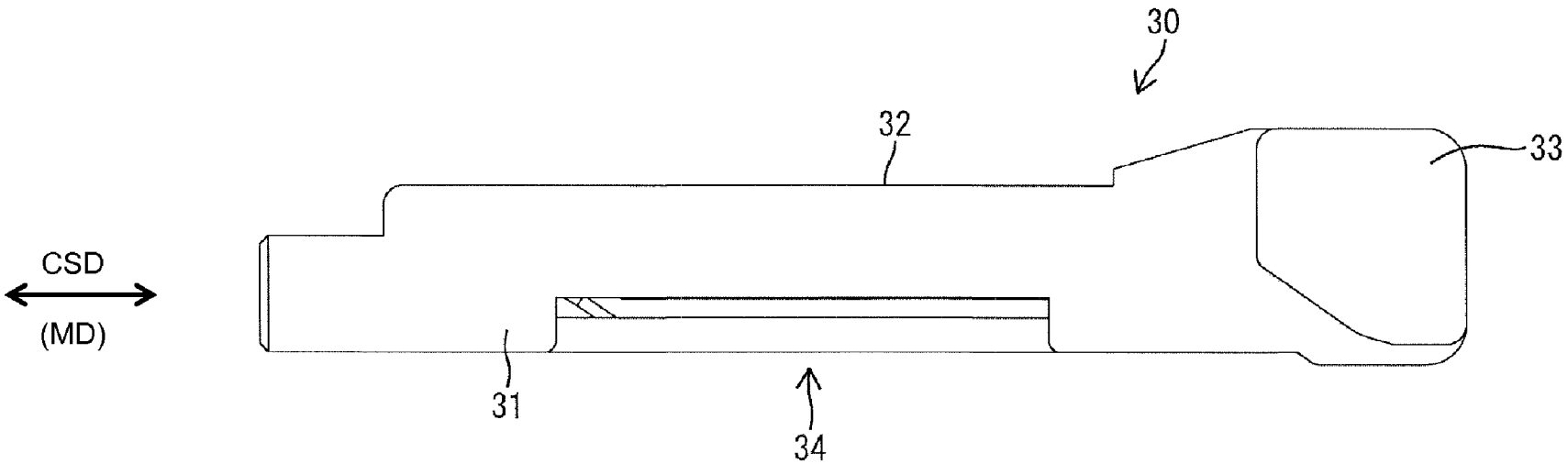
FIG. 12 is a side view of the detector.
Figure 13:
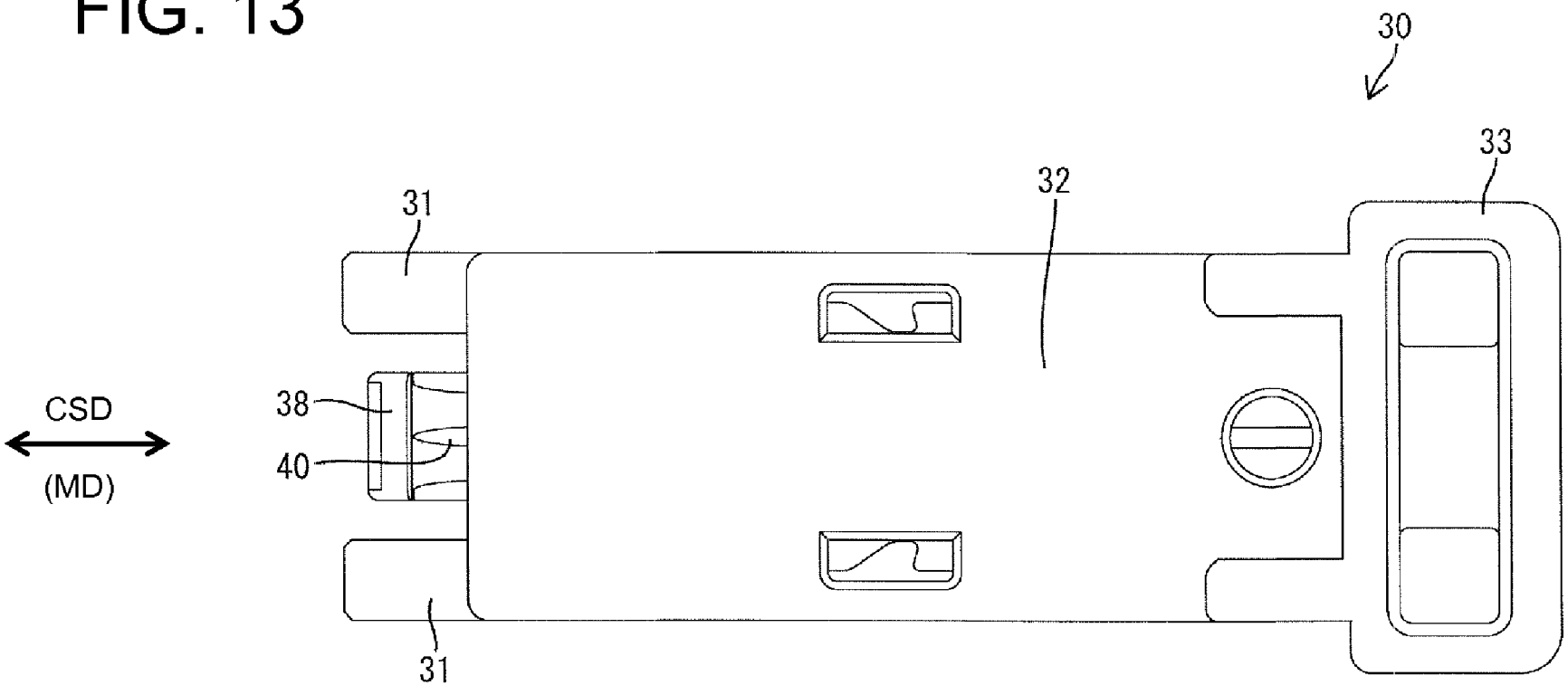
FIG. 13 is a plan view of the detector.
Figure 14:
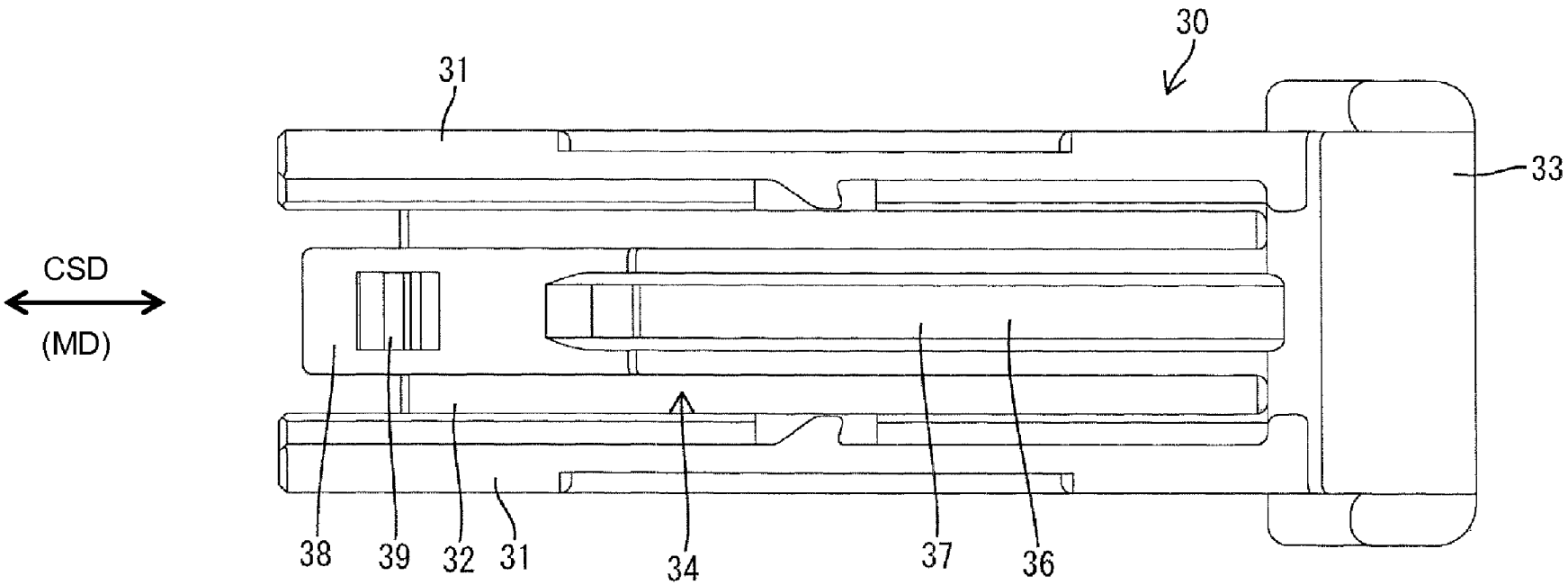
FIG. 14 is a bottom view of the detector.

The resilient piece 38 is accommodated in the guide space 26 and the restricting ribs 40 engage the restricting grooves 25 when the detector 30 is at the standby position SP shown in FIG. 5 to prevent lateral movements of the extension 34 relative to the lock arm 15. The reinforcing ribs 23 also hold the extension 34 from the left and right sides to prevent lateral movements of the extension 34 relative to the lock arm 15. Furthermore, the side frames 31 contact the outer side surfaces of the reinforcing ribs 23 to prevent lateral movements of the detector 30 relative to the lock arm 15.

The extension 34 is held between the base plate 18 and the connecting portion 24 to prevent vertical movements of the extension 34 relative to the lock arm 15. The front end of the connecting portion 24 is behind the rear end of the resilient piece 38 to avoid interference with the resilient piece 38 when the resilient piece 38 is deformed out or up. The lower surface of the flat plate 32 slides in contact with the upper surface of the connecting portion 24. Thus, the extension 34 and the flat plate 32 vertically sandwich the connecting portion 24.

The latch 39 of the resilient piece 38 enters the lock hole 22 from above and the front surface of the latch 39 engages the front end edge of the lock hole 22 (rear surface of the lock 19) from behind so that the latch projection 39 does not move further forward. This engagement holds the detector 30 at the standby position SP and prevents forward movement of the detector 30 to the detection position DP. The operable portion 33 projects back beyond the rear end of the lock arm 15 to enable a forward pushing operation, a backward pulling operation and a downward pressing operation.

Figure 4:
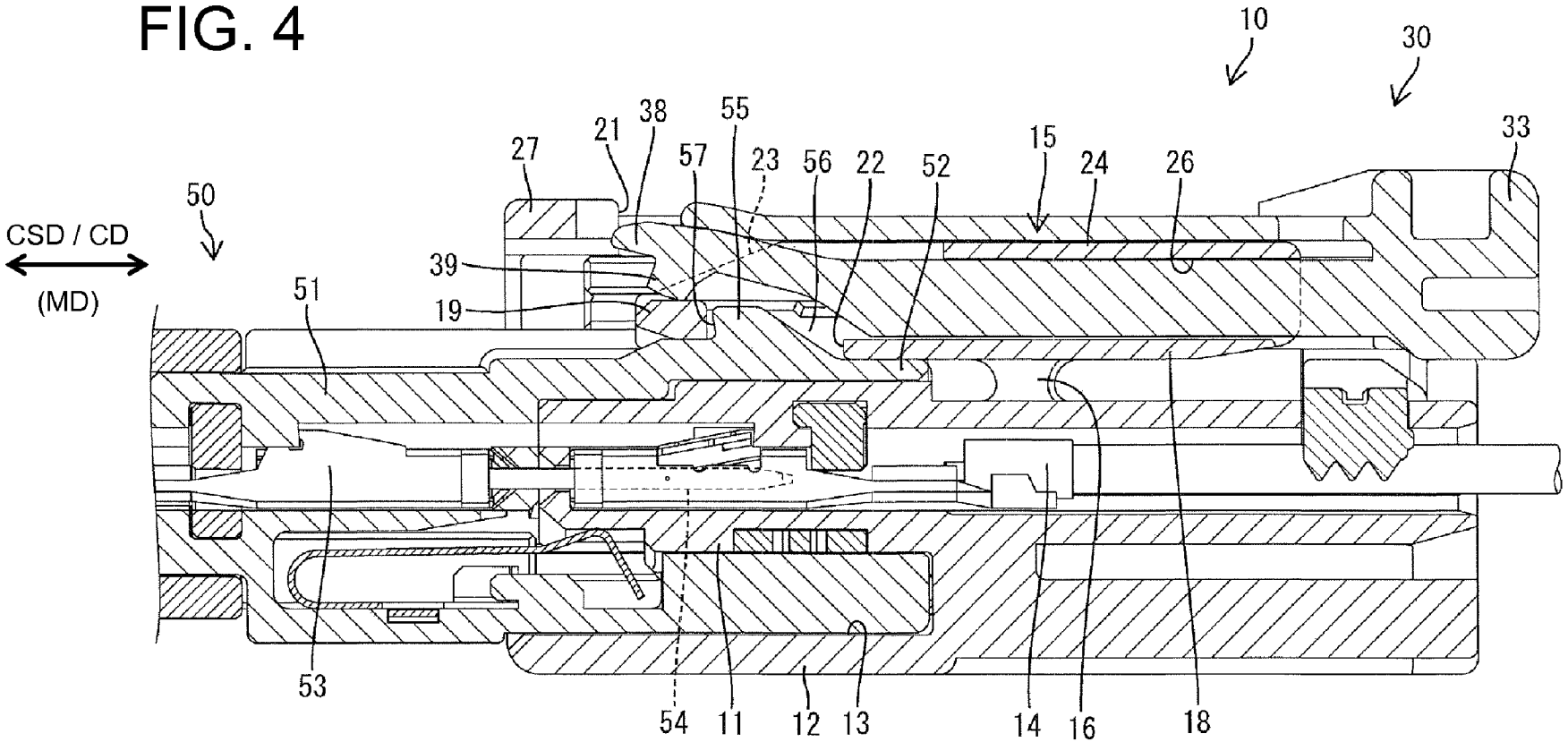
FIG. 4 is a section showing an intermediate state where two housings are connected properly and the detector is moving from the standby position to a detection position.

The second housing 50 includes a terminal holding portion 51 and a receptacle 52 projects forward from the terminal holding portion 51, as shown in FIG. 4. Male terminal fittings 53 are held in the terminal holding portion 51 so that tabs 54 at the leading ends of the male terminal fittings 53 project from the front surface of the terminal holding portion 51 and into the receptacle 52. A lock 55 projects out from upper surface of the upper wall of the receptacle 52. A guiding slant 56 is formed at the front of the lock 55 and is inclined with respect to the connecting direction CD of the housings 10, 50. A locking surface 57 is formed at the rear of the lock 55 and is substantially normal to the connecting direction of the two housings 10, 50.

Upon connecting the two housings 10, 50, the detector 30 is held at the standby position SP and, in this state, the two housings 10, 50 are brought closer to each other to insert the receptacle 52 into the connection space 13. As a result, the lock 19 at the front end of the lock arm 15 contacts and slides along the guiding slant 56 of the lock 55 of the second housing 50 so that the lock arm 15 deforms resiliently into the unlocking posture. The detector 30 also inclines with the lock arm 15 to displace the resilient piece 38 at the front end of the detector 30 out and up. In this partly connected state of the housings 10, 50, the latch 39 remains engaged with the lock hole 22. Thus, the detector 30 is held at the standby position SP and cannot move toward the detection position DP.

The lock 19 passes the lock projection 55 if the connecting operation proceeds sufficiently for the two housings 10, 50 to reach a properly connected state. Therefore the lock arm 15 restores resiliently toward the locking posture. The lock 19 engages the locking surface 57 of the lock projection 55 as the lock arm 15 resiliently restores so that the two housings 10, 50 are locked together in the properly connected state.

The lock 19 passes the lock projection 55 when the housings 10, 50 are locked in the properly connected state. Hence, the latch 39, which had been engaged with the lock 19 from behind, moves onto the lock 55 to prevent an inward or downward displacement. Accordingly, the resilient piece 38 displaces out and up with respect to the lock 19 at the front end of the lock arm 15 and disengages from the lock 19 as the lock arm 15 resiliently restores. In this way, the latch 39 and the lock 19 disengage and the detector 30 can move forward in the moving direction MD to the detection position DP.

The operable portion 33 then is pushed from behind to move the detector 30 forward from the standby position SP to the detection position DP. The latch 39 moves from the upper surface of the lock 55 and slides along the upper surface of the lock 19 in the process of moving the detector 30 to the detection position DP, as shown in FIG. 4.

The latch 39 passes the lock 19 when the detector 30 reaches the detection position DP. Thus, the resilient piece 38 restores resiliently so that the latch 39 engages the lock 19 from the front. The operable portion 33 projects back from the rear of the lock arm 15 even with the detector 30 at the detection position DP. Thus, proper connection of the housings 10, 50 is detected based on whether the detector 30 can be moved to the detection position DP.

The resilient piece 38 is below the restriction 27 at the front part of the upper wall of the tubular fitting 12 when the detector 30 is at the detection position DP, and hence the resilient piece 38 cannot be deflected up and out. Accordingly, the lock arm 15 cannot deform resiliently with the detector 30 to the unlocking posture and the two housings 10, 50 are locked reliably together.

To separate the housings 10, 50, the operable portion 33 is gripped to move the detector 30 from the detection position DP to the standby position SP. During this time, the resilient piece 38 deforms resiliently out and up so that the latch 39 moves onto the lock 19 and over to the upper surface of the lock 55. Thus, the resilient piece 38 moves to a position distanced back from the restriction 27 and can be deflected out and up.

The operable portion 33 then is pressed down so that the lock arm 15 is deformed to the unlocking posture together with the detector 30. This deformation of the lock arm 15 displaces the lock 19 up sufficiently to disengage from the lock 55 and to cancel the locking between the lock hole 22 and the lock 55. The two housings 10, 50 then may be pulled apart while keeping the lock arm 15 in the unlocking posture. The lock 19 is displaced up as the lock arm 15 resiliently deforms to the unlocking posture. Thus, the lock 19 engages the latch 39 from the front when the resilient piece 38 resiliently restores. This engagement action locks the detector 30 at the standby position SP. It is sufficient to resiliently restore the lock arm 15 to the locking posture after the two housings 10, 50 are separated. During this time, the detector 30 is kept at the standby position SP since the latch 39 remains engaged with the lock 19.

As described above, the reinforcing ribs 23 project from the lock arm 15 at opposite widthwise sides of the lock hole 22 and extend substantially from the front end of the lock arm 15 to positions behind the legs 16 that support the lock arm 15. The reinforcing ribs 23 increase rigidity of the front portion of the lock arm 15. Therefore, the front portion of the lock arm 15 will not deform to disengage the lock hole 22 from the latch 39 of the detector 30 even if the latch 39 exerts a strong pressing force on the edge of the lock hole 22 in a direction toward the detection position DP while the housings 10, 50 are separated. Accordingly, the detector 30 is held reliably at the standby position SP.

The lock arm 15 also has the connecting portion 24 that connects the reinforcing ribs 23. The connecting portion 24 further increases the rigidity of the reinforcing ribs 23 and makes the front portion of the lock arm 15 even less likely to deform.

The connecting portion 24 is a plate and is aligned parallel to the moving direction MD of the detector 30. The upper surface of the extension 34 of the detector 30 and the lower surface of the flat plate 32 of the detector 30 are held substantially in sliding contact with the connecting portion 24 when the detector 30 moves between the standby position SP and the detection position DP. Therefore, the detector 30 is guided by the connecting portion 24.

If the connecting portion 24 was formed over an area corresponding to a resiliently deformable part of the detector 30, the connecting portion 24 would have to be spaced from the detector 30 to define a space for permitting resilient deformation of the detector 30. Therefore, the height of the connector would have to increase. However, the connecting portion 24 is not in an area corresponding to the resilient piece 38 of the detector 30. Thus, a deformation space for the resilient piece 38 is ensured even if the connecting portion 24 is brought closer to the detector 30, and the connector can be miniaturized.

The operable portion 33 is formed at the rear end of the detector 30 and projects more backward than the connecting portion 24 at all positions in a movable range between the standby position SP and the detection position DP. Thus, an operator merely needs to operate the operable portion 33 to disengage the lock hole 22 from the lock projection 55 and to move the detector 30 between the standby position SP and the detection position DP. Accordingly, it is not necessary to form the lock arm 15 with a separate operable portion and the shape of the lock arm 15 is simplified.

The invention is not limited to the above described and illustrated embodiment. For example, the following embodiments are also embraced by the technical scope of the present invention.

Although the connecting portion is plate-like in the above embodiment, it may be a beam crossing between the pair of reinforcing ribs. In this case, one or more connecting portions may be provided.

The formation area of the connecting portion may be formed over the area corresponding to the part of the detector that is resiliently deformed as the latching projection moves onto the lock projection.

The reinforcing ribs are connected by the connecting portion in the above embodiment. However, the reinforcing ribs may not be connected by the connecting portion.

The lock arm may be provided with a special operable portion in addition to the operable portion of the detector.

The lock hole 22 is described as being a through-hole fully penetrating the lock arm 15 in the above embodiment. However, the lock hole may be a recess that does not fully penetrate the lock arm 15.

What is claimed is:

1. A connector, comprising:

a housing connectable with a mating housing, a lock arm provided displaceably on the housing and formed with a lock hole at front end portion thereof;

a detector mounted movably relative to the lock arm between a standby position and a detection position, a latch formed on the detector and engaging the lock hole when the housing is not connected to the mating housing and when the detector is at the standby position for preventing the detector from moving to the detection position, the lock arm moving onto a lock projecting on the mating housing during connection of the housing with the mating housing for causing the lock arm to incline resiliently together with the detector;

the lock arm restoring resiliently to engage the lock of the mating housing with the lock hole and to disengage the latch from the lock hole when the housings reach a properly connected state for locking the housings together and for enabling the detector to move toward the detection position, wherein an ability to move the detector to the detection position determines whether the housing is connected properly to the mating housing, and wherein at least one reinforcing rib projects from the lock arm for preventing the lock arm from deforming out of engagement with the detector before the housings are connected properly.

2. The connector of claim 1, wherein the at least one reinforcing rib is adjacent the lock hole and extends from a position in proximity to the front end of the lock arm to a position behind an inclination supporting point of the lock arm.

3. The connector of claim 1, wherein at least one reinforcing rib comprises plural reinforcing ribs, the lock arm further having a connecting portion connecting at least portions of the reinforcing ribs.

4. The connector of claim 3, wherein the connecting portion is a plate aligned substantially parallel to a moving direction of the detector and disposed to slide in contact with the detector.

5. The connector of claim 3, wherein the connecting portion is not in an area of the reinforcing ribs corresponding to a part of the detector that is resiliently deformable as the latch moves onto the lock.

6. The connector of claim 3, wherein an operable portion is formed at a rear end of the detector and projects more backward than the connecting portion.

7. A connector assembly, comprising:

a housing having opposite front and rear ends;

a mating housing connectable with the front end of the housing, a lock projecting from an outer surface of the mating housing;

a lock arm formed on the housing, the lock arm having opposite front and rear ends and at least one support between the front and rear ends of the lock arm, the lock arm being resiliently deformable about the support, a lock hole being formed in proximity to the front end of the lock arm;

a detector mounted to the lock arm for movement between a standby position and a detection position, a latch formed on the detector and engaging the lock hole when the housing is not connected to the mating housing and when the detector is at the standby position for preventing the detector from moving to the detection position, the lock of the mating housing moving into the lock hole and moving the latch out of the lock hole when the housings reach a properly connected state for locking the housings together and enabling the detector to move toward the detection position; and reinforcing ribs formed on the lock arm and disposed at least adjacent to the lock hole; wherein an ability to move the detector to the detection position determines whether the housing is connected properly to the mating housing, and wherein the reinforcing ribs prevent the lock arm from deforming out of engagement with the detector before the housings are connected properly.

8. The connector assembly of claim 7, wherein the reinforcing ribs extend from a position in proximity to the front end of the lock arm to a position behind the support of the lock arm.

9. The connector assembly of claim 8, the lock arm further has a connecting portion connecting at least portions of the reinforcing ribs.

10. The connector assembly of claim 9, wherein the connecting portion is a plate aligned substantially parallel to a moving direction of the detector and disposed to slide in contact with the detector.

11. The connector assembly of claim 10, wherein the connecting portion is not in an area of the reinforcing ribs corresponding to a part of the detector that is resiliently deformable as the latch moves onto the lock.

12. The connector assembly of claim 8, wherein an operable portion is formed at a rear end of the detector and projects more backward than the connecting portion.

* * * * *